United States Patent [19]

Dantlgraber et al.

[11] Patent Number: 4,697,990

[45] Date of Patent: Oct. 6, 1987

[54] VARIABLE CAPACITY VANE PUMP WITH MEANS TO VARY THE AREA OF OVERLAP

[75] Inventors: Jörg Dantlgraber, Lohr-Sackenbach; Josef Büdel, Wiestahl-Krommenthal; Josef Rüb, Lohr-Steinbach, all of Fed. Rep. of Germany

[73] Assignee: Mannesmann Rexroth GmbH, Lohr, Fed. Rep. of Germany

[21] Appl. No.: 823,110

[22] Filed: Jan. 27, 1986

[30] Foreign Application Priority Data

Jan. 25, 1985 [DE] Fed. Rep. of Germany ..... 3502519

[51] Int. Cl.[4] ..... F04B 23/10; F04B 49/00; F04C 2/344; F04C 15/02

[52] U.S. Cl. ..... 417/204; 417/220; 418/31

[58] Field of Search ..... 418/22, 24–27, 418/30, 31; 417/204, 220

[56] References Cited

U.S. PATENT DOCUMENTS 3,052,189 9/1962 Head ..... 418/27

4,578,948 4/1986 Hutson et al. ..... 418/30

*Primary Examiner*—John J. Vrablik

*Attorney, Agent, or Firm*—Cushman, Darby & Cushman

[57] ABSTRACT

The invention relates to a vane pump having input and output slot means. Either the input slot means or the output slot means are designed such that for a movement of the cam ring into a position of zero excentricity the area of overlap between the input slot means and the output slot means is increased.

15 Claims, 5 Drawing Figures

VARIABLE CAPACITY VANE PUMP WITH MEANS TO VARY THE AREA OF OVERLAP

The invention relates to vane pumps wherein a rotor having vanes slidably projecting from its periphery rotates about a fixed axis within a cam ring that encircles the rotor and shifts towards and from concentricity with the rotor as the volume of fluid delivered by the pump varies. At maximum flow, the ring is farthest from concentricity and at no flow the ring is substantially concentric with the rotor.

Depending on the position of the cam ring different amounts of fluid are supplied by the pump. One of the problems encountered in vane pumps is the noise which is created by the pump.

It is an object of the present invention to provide a vane pump which creates only a minimum amount of noise during operation. It is another object of the invention that a minimum amount of noise is created for all the different supply positions of the cam ring. The term "supply position" implies the fact that different amounts of fluid are supplied by the pump for different positions of the cam ring.

It is another object of the invention to provide for a precise optimisation of the noise situation for different supply positions.

A vane pump of the type which the invention refers to is disclosed in U.S. Pat. No. 3,272,138 and also in the inventor's copending U.S. application Ser. No. 654,932, filed Sept. 27, 1984. The latter application corresponds to German Offenlegungsschrift No. 33 35 879.

The invention provides for a vane pump comprising a housing and a cam ring. The cam ring is movably mounted within said housing, so as to provide for an adjustment of the amount of fluid supplied. A rotor carrying vanes is rotatably mounted within the housing and within the cam ring, so that the vanes move along the inner surface of the cam ring. At least one inlet port in the form of an inlet slot is provided for drawing fluid into the pump. Further, at least one outlet port in the form of an outlet slot is provided to supply the pressurized fluid to a user. As is well known, said inlet and outlet slots are typically provided in discs which are located adjacent to the rotor. Seen in direction of rotation of the rotor the inlet slot defines a beginning and an end of the inlet slot. Likewise, the outlet slot defines a beginning and an end. The area between the end of the inlet slot and the beginning of the outlet slot is called the area of overlap (overlap area). If one of the fluid pumping chambers defined by two neighbouring vanes is located in said overlap area, said chamber is neither in connection with the inlet slot nor the outlet slot.

It should be noted that there is at least one inlet port and at least one outlet port. However, more than just one inlet port and one outlet port may be provided.

In accordance with the present invention the inlet slot and/or the outlet slot are formed such that the area of overlap between the end of the inlet slot and the beginning of the outlet slot is increased when the cam ring is moved towards its center position, i.e. towards the position where the amount of fluid supplied by the pump is zero.

According to a preferred embodiment of the invention a bight portion is formed at the beginning of the outlet slot, said bight portion extending towards the end of the inlet slot.

In accordance with another embodiment of the invention a bight portion is provided at the end of the inlet slot extending towards the beginning of the outlet slot.

In accordance with another embodiment of the invention bight portions are provided at the end of the inlet slot and at the beginning of the outlet slot. Said bight portions extend towards each other and are formed such that the area of overlap increases when the cam ring is moved towards its position of centricity.

Other objects and advantages of the present invention will become more readily apparent upon reference to the accompanying drawings and the following description.

BRIEF DESCRIPTION OF THE DRAWINGS

In FIG. 1 a prior art vane pump 100 is shown in a sectional view. Vane pump 100 comprises in substance a schematically shown housing 11 within which a cam ring 3 is movably mounted and adapted for cooperation with a rotor 2 carrying vanes 4, 5. The cam ring 3 is provided with an internal running area (inner surface) adapted for cooperation with said vanes 4, 5. When rotating the rotor 2, the radially movable vanes 4, 5 will be urged outwardly and the outer edges of the vanes will be in engagement with the inner surface 12 of the cam ring 3 due to the centrifugal force and due to the system pressure which is effective behind the vanes, i.e. at the radially inner ends of the vanes. Each one pair of vanes, for example, the vanes 4 and 5 form together with the rotor 2, the cam ring 3 and the two discs located at opposite sides working or fluid pumping chambers. One of said fluid pumping chambers is referred to by reference numeral 1. The discs just mentioned are well known in the art and are therefore not described in any detail. One of said oppositely located discs is shown at 21 in FIG. 1. As is well known, in at least one of said two discs suction or inlet slots and/or pressure or outlet slots are provided. For the pump of FIG. 1 two radially offset inlet slots 6 and 7 and two radially offset outlet slots 8 and 9 are provided. Inasmuch as the cam ring 3 shown in FIG. 1 comprises a single excentric inner surface (for instance in contrast to a double-excentric design) a pair of inlet slots 6, 7 and a pair of outlet slots 8, 9 is sufficient. As is well known, the pressure medium (fluid), for instance, hydraulic liquid is supplied to the pump via the inlet slots 6 and 7 while the removal of the liquid occurs via output (outlet) shoes 8 and 9.

Figure 1:
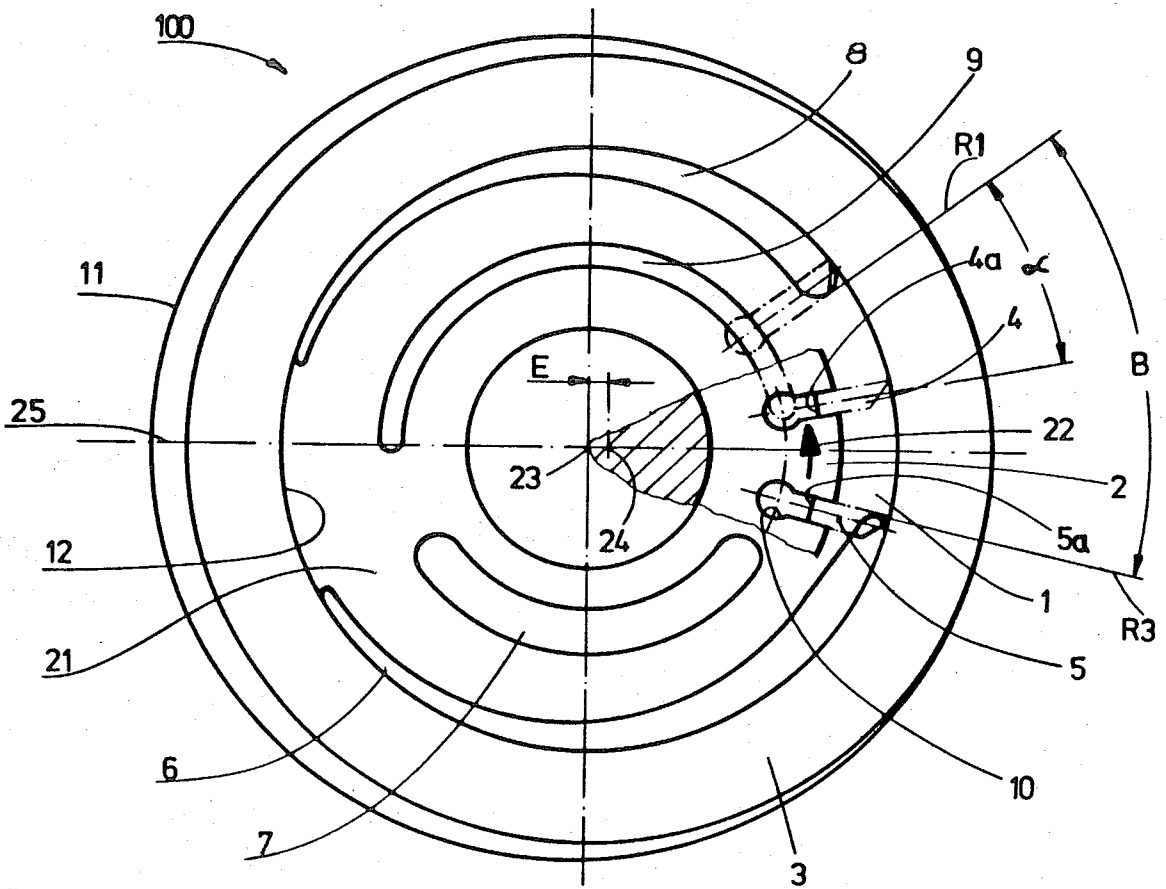
FIG. 1 (PRIOR ART)
FIG. 1 is a schematic sectional view of a prior art vane pump with the secitonal plane extending perpendicular to the longitudinal axis of the rotor.

The fluid pumping chambers 1 cooperate with the inlet slot 6 and the outlet slot 8, respectively. Chambers formed adjacent to the bottom edges 4*a*, 5*a* of the vanes cooperate with the inlet slot 7 and outlet slot 9, respectively.

The cam ring 3 is movable within the housing 11 along transversal axis 25 of the housing 11. The cam ring 3 may be moved from its position of maximum excentricity, as is shown, into a position with the excentricity being zero. The excentricity is designated E in FIG. 1 and is defined by the distance between the center 23 of the rotor and the center 24 of the cam ring.

In order to initiate the pumping operation of the pump 100 the rotor 2 is caused to rotate in the direction of arrow 22. Initially in the area of the inlet slot 6 (as well as in the area of the inlet slot 7) the volume of the pumping chamber 1 is still small but increases with the continued rotation and is filled during said continued rotation with fluid. If the pumping chambers 1 under consideration have reached their maximum size, they will be separated from the suction or inlet side of the pump and will then be brought into connection with the outlet or pressure side of the pump. The maximum size will be achieved when the greatest distance of the inner surface 12 with respect to the center 23 of the rotor is present. Continuing with the description of the operation, one realizes that for the further rotation of the rotor the inner surface 12 causes the vanes 4, 5 to be moved into their slots in the rotor and the volume or size of the pumping chambers will now decrease. The fluid within said pumping chambers will then be urged to the outlet slot 8 (and also the outlet slot 9).

The moment of operation shown in FIG. 1 refers to a situation where the vane 5 is just separating pumping chamber 1 from the inlet slot 6. The further rotation of the rotor 2 in the direction of arrow 22 will decrease the volume of the pumping chamber 1 and consequently the pressure within pumping chamber 1 will increase. After rotation of the rotor 2 about an angle $\alpha$, vane 4 will open the connection of the pumping chamber 1 to the outlet slot 8.

So as to obtain optimum noise (i.e., a noise level as low as possible), the following is necessary:

At the moment the pumping chamber 1 is opened towards the outlet slot 8, the pressure in the pumping chamber 1 has to be equal to the pumping pressure existing in the outlet slot 8. It is to be noted in this context that the increase of pressure depending on the angle of rotation is determined by the excentricity E, i.e. the distance between the center 23 of the rotor and the center 24 of the cam ring. When the excentricity E is increased, the increase of pressure depending on the angle of rotation will also increase. Similar considerations are true for the separation of the pumping chamber 1 with respect to the inlet slot 6. Again, analog considerations are valid for the outlet slot 9 and the inlet slot 7.

Known designs for the beginning of slots and the ending of slots, respectively, are optimized only for one specific amount of excentricity, i.e. an optimum is obtained only for a certain displacement. Such a solution as well as the use of so-called precontrol grooves does not lead to an exact optimization for different excentricities.

In FIG. 1 different radii starting from the center 23 of the rotor are shown. Radius R1 defines the beginning of the output slot 8. Radius R3 defines the end of the input slot 6. The angular distance between radius R1 and radius R3 is defined as the area of overlap B. It will be noted that for the pump of FIG. 1 the area of overlap between the end of the input slot and the beginning of the output slot remains in substance constant when the cam ring 3 is moved along the transversal axis 25 in the direction of zero excentricity or zero fluid flow. As mentioned, in FIG. 1 cam ring 3 is shown in its position corresponding to maximum flow.

Figure 2:
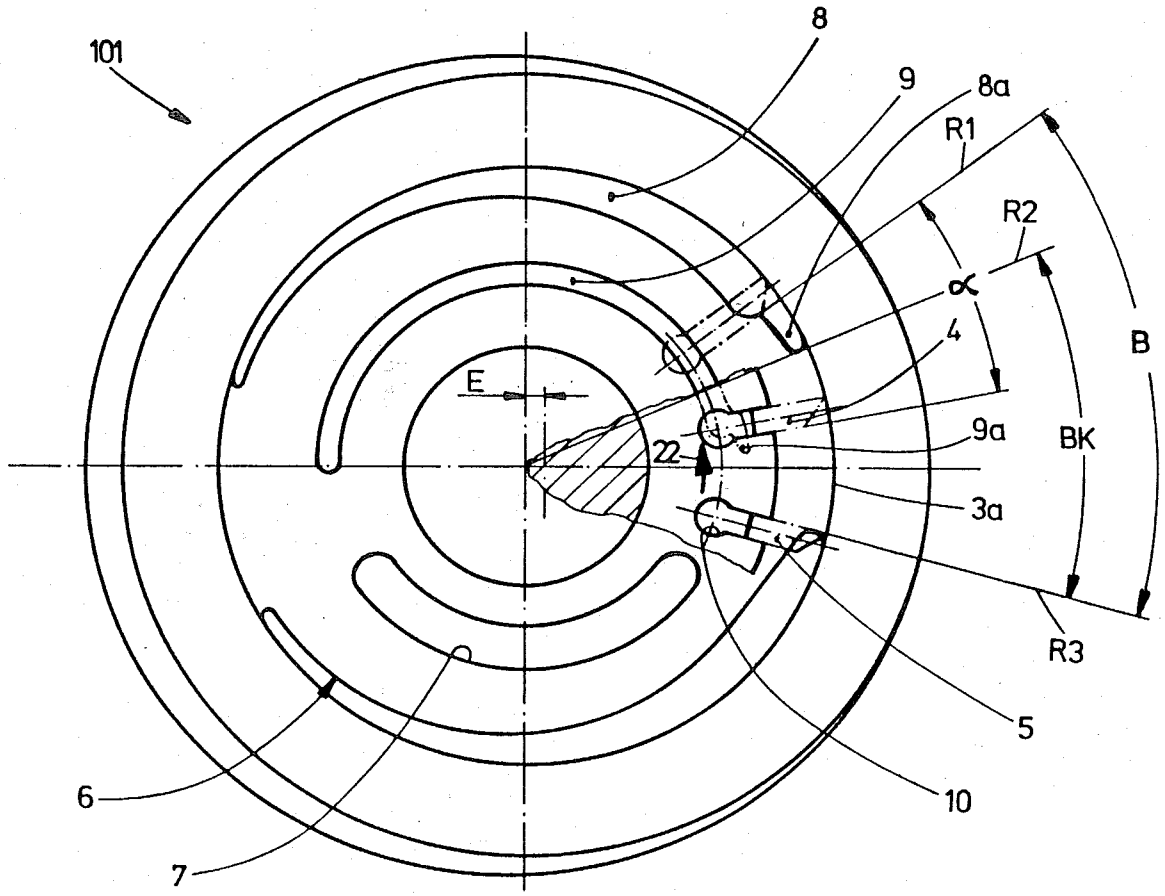
FIG. 2 is a sectional view similar to FIG. 1 of a vane pump according to a first embodiment of the invention.
Figure 3:
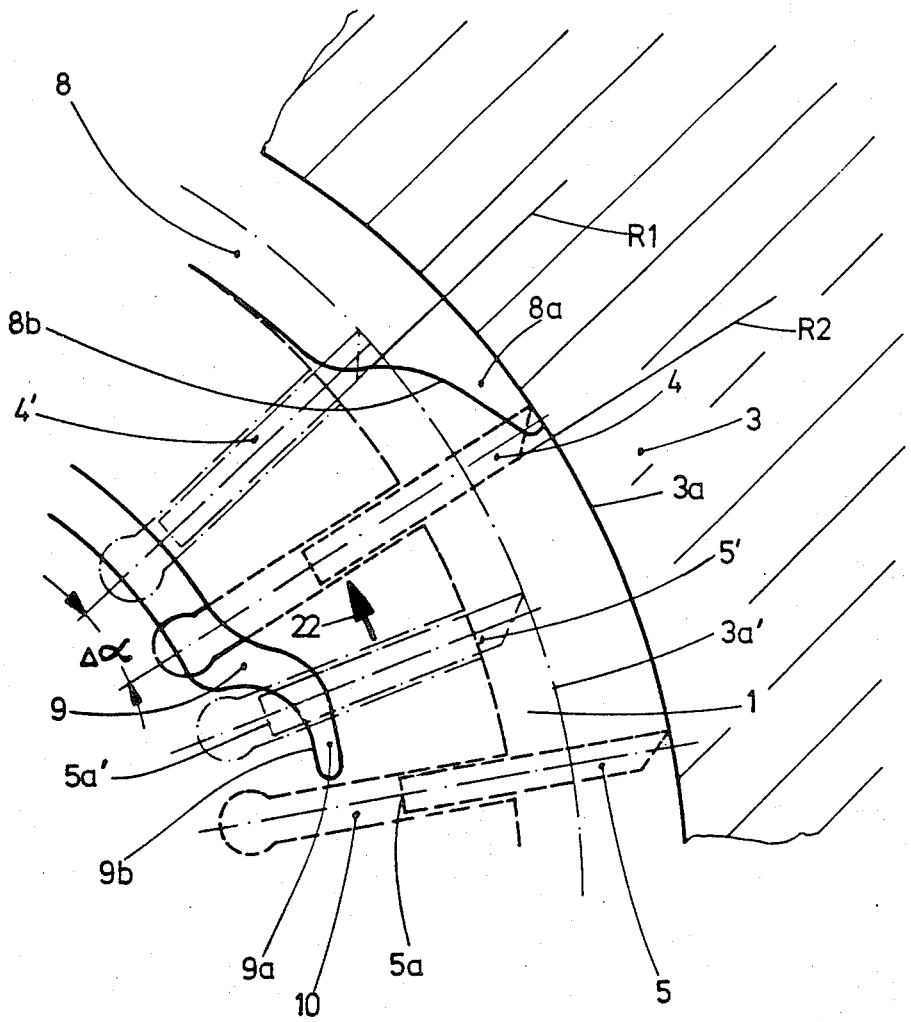
FIG. 3 is a detail of the representation of FIG. 2 showing the features of the invention in detail.

FIG. 2 is a sectional view similar to FIG. 1 showing a first embodiment of a vane pump 101 of the invention. FIG. 3 is a detail of FIG. 2 in the area of the beginning of the output or pressure slot.

In accordance with the invention, the beginning or start of the output slot is designed such that regardless of the excentricity present a precise optimization of the pump operation is achieved. In particular, the design is such that the area of overlap defined between the ends of the inlet or suction slot and the beginning of the output slot will be increased due to the design of the input slot and/or the output slot when the cam ring 3 is moved out of its maximum position of excentricity towards its position of zero flow (position of zero excentricity).

The embodiment of FIGS. 2 and 3 discloses for a pump of the type shown in FIG. 1 a situation where the beginning of the output slot 8 is extended in a finger-like manner in the direction towards the end of the input slot 6. At the beginning of the output slot which normally ends at radius R1, a bight portion 8*a* is provided in a contiguous manner. This bight portion 8*a* at the beginning of the outlet slot tapers in tangential or circumferential direction. In FIG. 3 reference number 3*a* designates the cam ring 3 in its "maximum flow" position while the inner surface of cam ring 3 in its position "zero flow" is designated by reference numeral 3*a*'. The bight portion 8*a* at the start of the output slot starts from the beginning of the output slot approximately at a location where the inner surface 3*a*' and the radius R1 cut each other, as is shown in FIG. 3. The bight portion 8*a* extends approximately towards a radius R2.

It will be noted that the area of overlap B as shown in FIG. 2 and defined between radius R1 and R3 for the situation of zero flow will decrease to an area of overlap Bk defined between radius R2 and R3 when the cam ring 3 is moved into its position of maximum flow.

As is shown in FIGS. 2 and 3, the output slot 9 for the pressure chambers 10 is also designed such that the area of overlap (not shown for output slot 9 in the Figure) between the end of the input slot 7 and the beginning of the output slot 9 will increase when the cam ring 3 is moved in the direction of zero flow. Accordingly, output slot 9 is provided at its beginning with a bow-shaped bight portion 9*a* which extends in the direction towards the end of the input slot 7. The contours 8*b* of the bight portion 8*a* and 9*b* of the bight portion 9*a* are designed such that for the intermediate positions between the amount of flow Q=zero and the amount fo flow Q=maximum the optimum start of compression is present.

Reference numerals 4' and 5' show in FIG. 3 the vanes 4 and 5 in the position for the fluid flow Q=zero. Likewise, reference numeral 5*a*' refers to the bottom edge of vane 5'.

Figure 4:
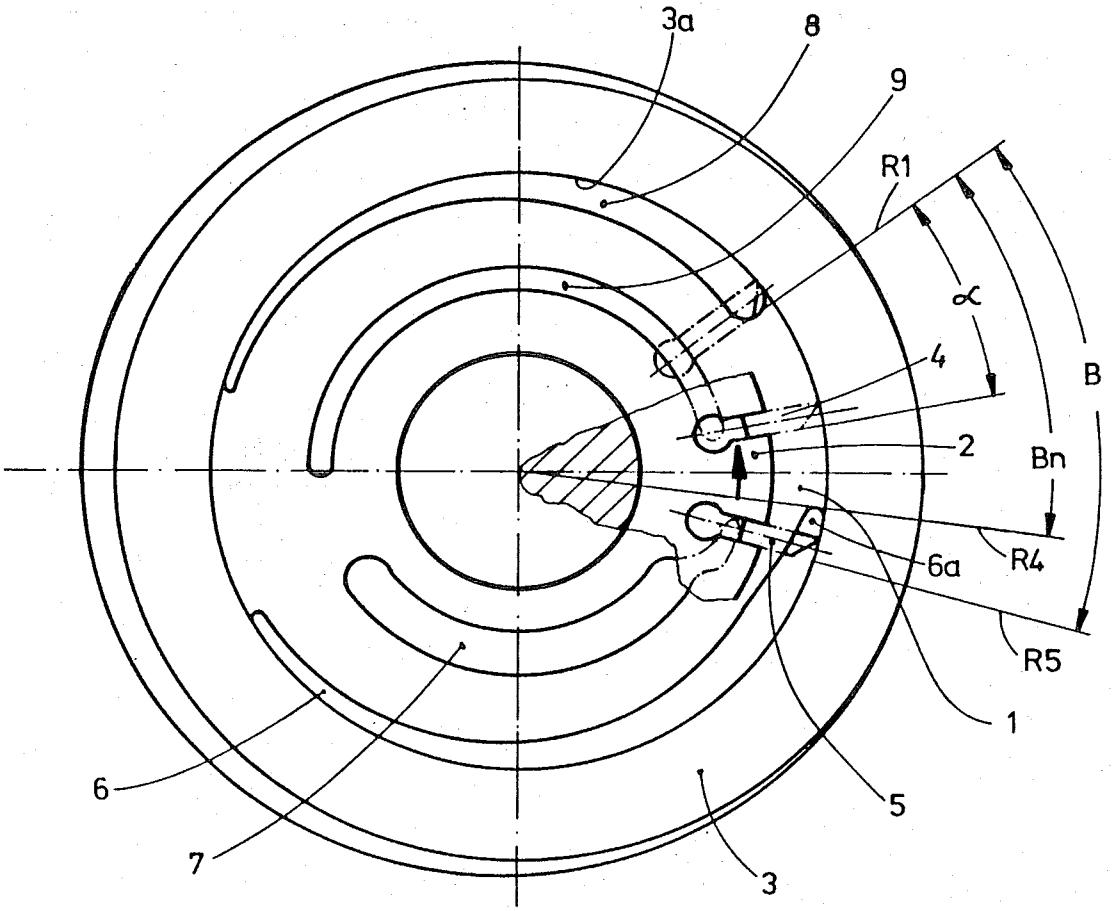
FIG. 4 is a sectional view similar to FIG. 1 of a vane pump according to a second embodiment of the invention.
Figure 5:
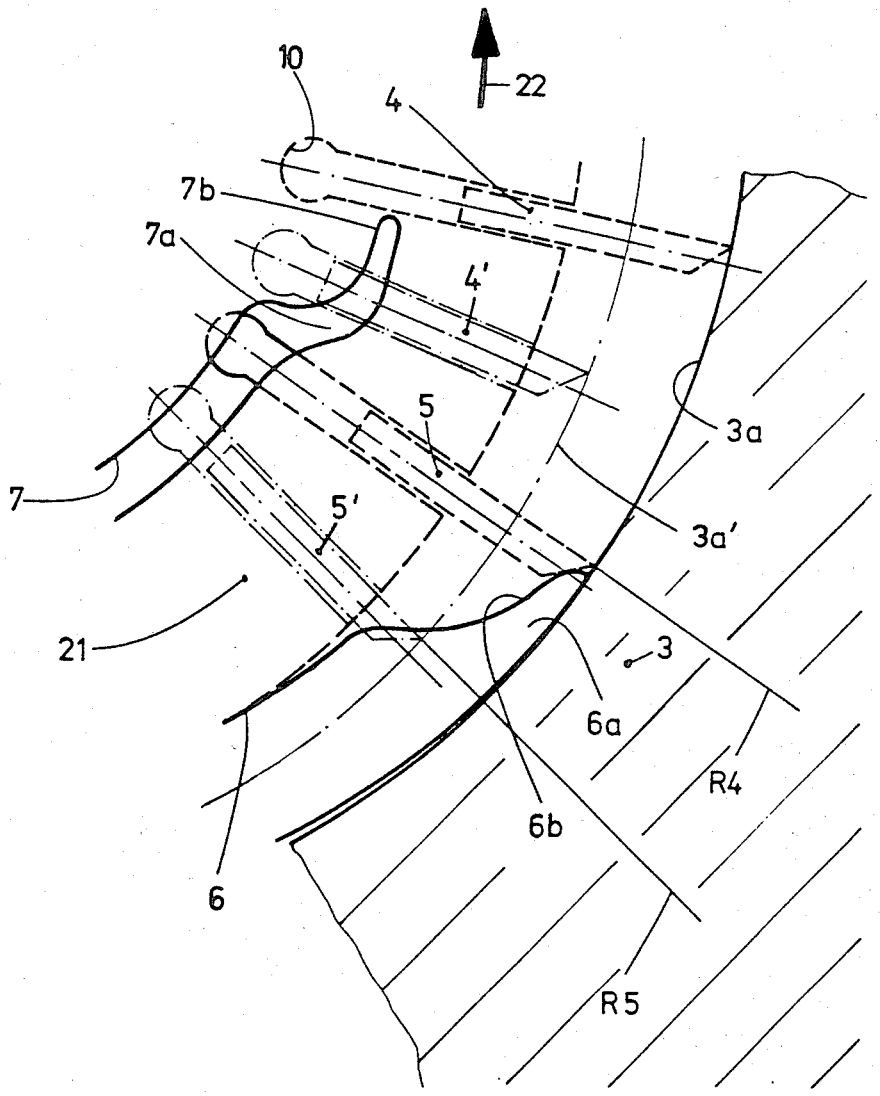
FIG. 5 is a detail of FIG. 4.

FIGS. 4 and 5 disclose another embodiment of the invention in sectional views similar to the view of FIGS. 2 and 3. In contrast to the embodiment of FIGS. 2 and 3, the ends of the input slots 6 and 7 are extended in the direction towards the beginnings of the output slots 8 and 9, respectively. Similar reference numerals as used in the preceding Figures will be used for similar components so as to simplify the description.

In accordance with the invention, at the end of the input slot 6 a bight portion 6*a* is provided. The bight portion 6*a* extends finger-like along the inner surface 3*a* of the cam ring 3 which is in its position of maximum flow. The bight portion 6*a* starts from the end of the inlet slot 6 at a location where the inner surface 3*a'* of the cam ring 3 in its position for zero flow cuts the end of the input slot, an end which normally ends at the radius R5. The bight portion 6*a* extends in the direction towards the beginning of the output slot up until radius R4.

Similarly, the radially inwardly located pressure or input slot 7 is provided with a bight portion 7*a* which extends in a curved manner in the direction towards the beginning of output slot 9. The contours 6*b* and 7*b* of the bight portion 6*a* and 7*a*, respectively, are formed such that in the intermediate positions of the cam ring between Q=zero and Q=maximum, an optimum termination of the input of the fluid is achieved.

In accordance with an embodiment not shown, the design of the input and of the output slots shown in FIGS. 2 and 4 are used in combination in a pump.

What I claim is:

1. A vane pump comprising a housing, a cam ring within said housing adapted for movement between the position of minimum and a position of maximum excentricity, a rotor rotatably mounted in said housing and located in said cam ring, vanes slidably projecting from the periphery of the rotor and defining fluid pressure chambers therebetween, said cam ring defining an inner surface along which said vanes move when said rotor is rotated, input slot means provided in said housing means for supplying fluid to said pressure chambers, output slot means provided in said housing means for outputting the pressurized fluid, said input slot means defining a beginning and an end, said output slot means defining a beginning and an end, wherein the circumferential distance between the end of the input slot means and the beginning of the output slot means defines an area of ovrlap within which a pumping chamber is separated from the input slot means and the output slot means, and wherein at least one of the end of the input slot means and the beginning of the output slot means includes a bight portion extending towards the other of said slot means, said bight portion having a width that gradually changes along substantially the entire length thereof such that when the cam ring is moved from a position of substantially maximum excentricity towards a position of substantially minimum excenticity, the effective length of said at least one of said input slot means and said output slot means is gradually decreased, whereby the area of overlap between the end of the input slot means and the beginning of the output slot means is increased.

2. A vane pump comprising a housing, a cam ring within said housing adapted for movement between a position of minimum and a position of maximum excentricity, a rotor rotatably mounted in said housing and located in said cam ring, vanes slidably projecting from the periphery of the rotor and defining fluid pressure chambers therebetween, said cam ring defining an inner surface along which said vanes move when said rotor is rotated, input slot means provided in said housing means for supplying fluid to said pressure chambers, output slot means provided in said housing means for outputting the pressurized fluid, said input slot means defining a beginning and an end, said output slot means defining a beginning and an end, wherein the circumferential distance between the end of the input slot means and the beginning of the output slot means defines an area of ovrlap within which a pumping chamber is separated from the input slot means and the output slot means, and wherein the end of the input slot means includes a bight portion extending towards the beginning of the output slot means, said bight portion having a width that gradually decreases along substantially the entire length thereof such that when the cam ring is moved from a position of substantially maximum excentricity towards a position of substantially minimum excentricity, the effective length of the input slot is gradually decreased, whereby the area of overlap between the end of the input slot means and the beginning of the output slot means is increased.

3. The pump of claim 1 wherein said input slot means comprises a first input slot and a second input slot, said first input slot being adapted for cooperation with said pressure chambers and said second input slot being adapted to cooperate with chambers provided adjacent to the bottom edges of said vanes.

4. The pump of claim 3 wherein said first slot is provided with a bight portion at its end extending towards said output slot means.

5. The pump of claim 3 wherein said second slot comprises at its end a bight portion extending in circumferential direction towards the output slot means.

6. The pump of claim 1 wherein said input slot means comprises a plurality of input slots.

7. The pump of claim 1 wherein said input slot means comprises a plurality of radially inwardly offset input slots.

8. The pump of claim 4 wherein said bight portion is essentially finger-shaped and extends from the end of the input slot substantially parallel to the inner surface of the cam ring located in its position of maximum excentricity.

9. A vane pump comprising a housing, a cam ring within said housing adapted for movement between a position of minimum and a position of maximum excentricity, a rotor rotatably mounted in said housing and located in said cam ring, vanes slidably projecting from the periphery of the rotor and defining fluid pressure chambers therebetween, said cam ring defining an inner surface along which said vanes move when said rotor is rotated, input slot means provided in said housing means for supplying fluid to said pressure chambers, output slot means provided in said housing means for outputting the pressurized fluid, said input slot means defining a beginning and an end, said output slot means defining a beginning and an end, wherein the circumferential distance between the end of the input slot means and the beginning of the output slot means defines an area of ovrlap within which a pumping chamber is separated from the input slot means and the output slot means, and wherein the beginning of the output slot means includes a bight portion extending towards the end of the input slot means, said bight portion having a width that gradually increases along the length thereof such that when the cam ring is moved from a position of substantially maximum excentricity towards a position of substantially minimum excentricity, the effective length of the output slot means is gradually decreased, whereby the area of overlap between the end of the input slot means and the beginning of the output slot means is increased.

10. The pump of claim 9 wherein said output slot means comprises a first output slot and a second output slot, said first output slot being adapted for cooperation with said pressure chambers and said second output slot being adapted for cooperation with the chambers provided adjacent to the bottom edges of said vanes.

11. The pump of claim 10 wherein said first output slot is provided with a bight portion at its beginning extending towards said input slot means.

12. The pump of claim 10 wherein said second output slot comprises at its beginning a bight portion extending in circumferential direction towards the input slot means.

13. The pump of claim 9 wherein said output slot means comprises a plurality of output slots.

14. The pump of claim 9 wherein said output slot means comprises a plurality of radially inwardly offset output slots.

15. The pump of claim 11 wherein said bight portion is essentially finger-shaped and extends from the beginning of the output slot substantially parallel to the inner surface of the cam ring which is located in its position of maximum excentricity.

* * * * *